US005897468A

United States Patent [19]

Lumpkin

[11] Patent Number: 5,897,468

[45] Date of Patent: Apr. 27, 1999

[54] TRAINING AID

[76] Inventor: Eric Lumpkin, 22621 NE. Schuyler St., Troutdale, Oreg. 97060

[21] Appl. No.: 09/099,866

[22] Filed: Jun. 18, 1998

Related U.S. Application Data

[62] Division of application No. 08/857,476, May 15, 1997, abandoned.

[51] Int. Cl.[6] ..... A63B 21/078

[52] U.S. Cl. ..... 482/106; 482/93; 2/92; 2/463

[58] Field of Search ..... 482/92–94, 104, 482/105, 106–108; 2/92, 463

[56] References Cited

U.S. PATENT DOCUMENTS

| | | | |
|---|---|---|---|
| 4,394,012 | 7/1983 | Egbert et al. | 482/105 |
| 4,800,593 | 1/1989 | Ruffner | 2/92 |
| 5,058,886 | 10/1991 | Jackson | 482/106 |

*Primary Examiner*—John Mulcahy
*Attorney, Agent, or Firm*—Smith-Hill and Bedell

[57] ABSTRACT

An exercise aid is composed of a harness which is worn on the lifter's chest when performing the bench press exercise and has left and right sides disposed at opposite respective sides of a central plane of the harness. The harness includes two pockets which are symmetrically disposed about the central plane. A stiff plate can be removably inserted in each pocket to provide a spacer which limits the extent to which the bar can be lowered.

5 Claims, 3 Drawing Sheets

TRAINING AID

CROSS-REFERENCE TO RELATED APPLICATION

This application is filed as a divisional of patent application No. 08/857,476 filed May 15, 1997, now abandoned.

BACKGROUND OF THE INVENTION

This invention relates to a training aid.

When doing the exercise known as the bench press, a lifter lies on a horizontal bench with his buttocks, shoulders and head in contact with the bench. The knees are bent so that the feet can be placed flat on the floor, which assists in stabilizing the lifter on the bench. The lifter reaches up and grasps a barbell in both hands. The lifter takes a deep breath, stabilizing the chest to give a firm base for the muscular action involved in the lift. In his own time, the user lowers the barbell to his chest. This must be done under control.

The lifter drives the bar from the chest, in the initial starting position, when the barbell is resting on the chest, it will not lie over the fulcrum of the shoulder joint but will be some 2 or 3 inches forward of this point. This means that there is a forward weight arm and consequent mechanical disadvantage right from the start of the drive. The forward weight arm must be eliminated and in order to do this the user eases the barbell back during the drive to bring it over the shoulder fulcrum. While the drive must be very determined, care must be taken to ensure that the elbows are not lifted upwards and forward, as this would throw too great a resistance on the triceps too soon. It will be in the mid-range of the movement that the user will encounter the greatest difficulties. This area is known as the "sticking point" or point of the greatest mechanical and anatomical disadvantage. Here the horizontal weight arms are at their greatest and there is a weak link between the change over of one muscle group to another. The initial part of the drive is developed by strong action of the pectoralis major, anterior deltoid and serratus anterior. At the mid-section of the press, the role of these muscles is diminishing and the triceps are beginning to take on a greater responsibility in the movement. It is here that the weakness occurs. As the barbell passes through the mid-range, it becomes increasingly easy to complete the movement. The lift is completed when the arms are fully straightened.

It is important to note that the groove is a spot that is 1 to 3 inches up from the bottom of the lower pectoralis major. Maintaining the groove position is very important, in order to obtain the best mechanical advantage.

The aim in the bench press exercise is to complete a certain number of repetitions, e.g. 10 repetitions, with a given weight on the barbell. The lifter may train at a first weight level until he is comfortable at that weight level and can perform the desired number of repetitions, and then increase the weight of the barbell to a higher level and train at the higher level until he is comfortable at that weight level and can perform the desired number of repetitions. In this manner, the lifter progressively increases the weight level at which he exercises.

There are mental and physical barriers to increasing the weight level in the bench press exercise. First, the effort that the lifter can exert when pushing the barbell upward is lower when the barbell is just touching the lifter's chest than when the barbell is slightly above the lifter's chest and consequently, when the weight of the barbell is increased, the fear of being unable to raise the barbell may intimidate the lifter as he lowers the barbell and he might not lower the barbell fully, so that it touches his chest. Secondly, assuming that the lifter is able to lower the barbell at the higher weight level so that the bar just touches his chest, there is a danger of injury, particularly to the shoulder, on exerting the effort needed to raise the barbell at the higher weight level.

SUMMARY OF THE INVENTION

In accordance with the present invention there is provided a training aid, for assisting a lifter in training for the bench press exercise, in which the lifter lifts a bar from a lower position to a higher position relative to the lifter's shoulders, said training aid comprising a harness to be worn by the lifter, and at least one spacer attached to the harness at a position in which the spacer is below the bar when the harness is in use and the bar is in its lower position, the spacer limiting the extent to which the bar can be moved from its higher position toward its lower position before contacting the exercise aid.

BRIEF DESCRIPTION OF THE DRAWINGS

For a better understanding of the invention, and to show how the same may be carried into effect, reference will now be made, by way of example, to the accompanying drawings, in which.

DETAILED DESCRIPTION

Figure 1:
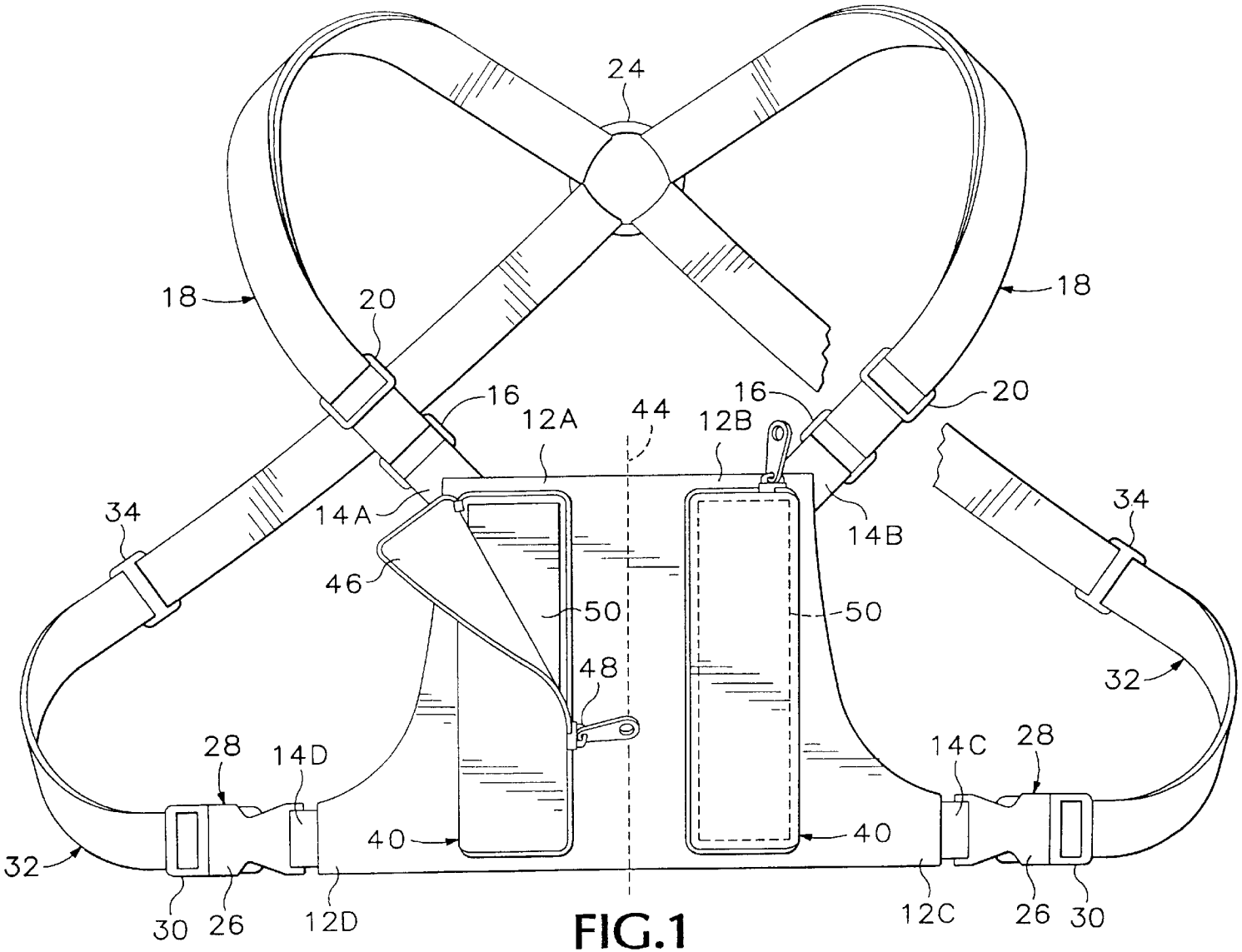
FIG. 1 is a front elevation, partly broken away, of a first training aid in accordance with the present invention.
Figure 3:
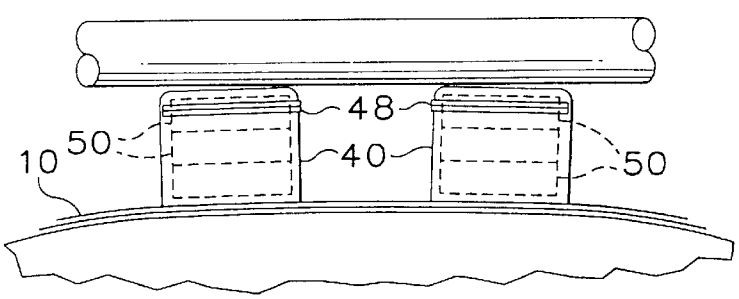
FIG. 3 is a view on the line III—III of FIG. 2.
Figure 2:
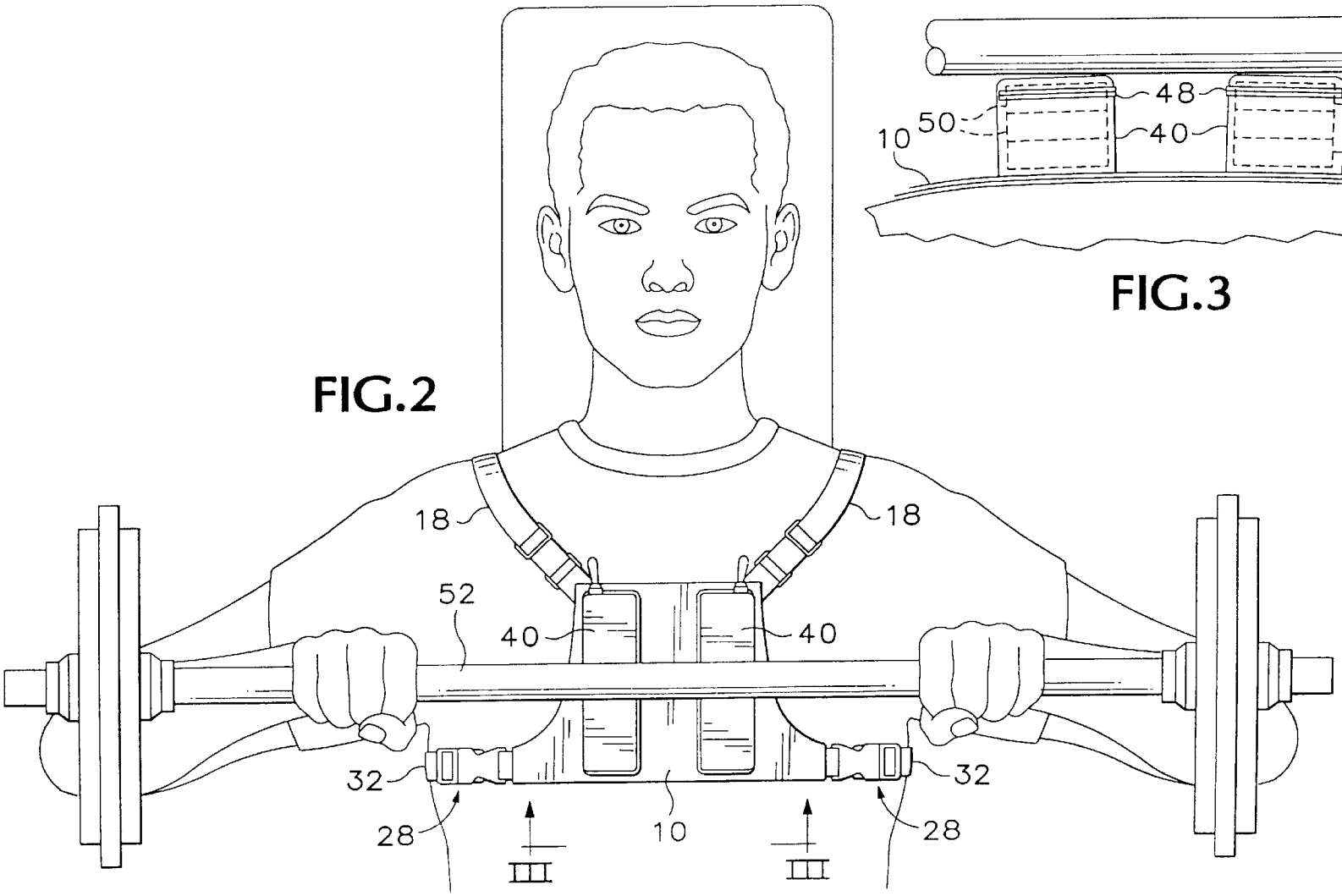
FIG. 2 is a top plan view showing the training aid in use.

The first training aid, which is shown in FIGS. 1–3, is in the form of a harness which is worn by a weight lifter to aid in progressing to a higher weight level when performing the bench press exercise. The harness comprises a generally trapezoidal component 10 of a tough sheet-form fabric material having corner regions 12A, 12B, 12C and 12D. At each corner region 12, an anchor 14 is securely attached to the component 10. The two upper anchors 14A and 14B include rectangular link elements 16 each attached to one end of an upper strap 18. The opposite end of the upper strap 18 is attached to an outer bar of a slide buckle 20, and the strap is threaded through the buckle 20 to form a loop. The loop formed by the slide buckle 20 passes through a central ring 24. By adjusting the slide buckle 20 along the strap 18, the effective length of the upper strap between the anchor 14A or 14B and the ring 24 is adjustable. The two lower anchors 14C and 14D each include one part 26 of a quick-release clip 28, the other part 30 of which is attached to one end of a lower strap 32. The opposite end of the lower strap 32 is attached to an outer bar of a slide buckle 34 to form a loop. The loop formed by the slide buckle 34 passes through the central ring 24 and by adjusting the slide buckle 34 the effective length of the lower strap between the anchor 14C or 14D and the ring 24 is adjustable.

On the front of the trapezoidal fabric component 10 are two pockets 40 each defining a generally parallelepipedal cavity. The pockets are made of a tough flexible material. The longer dimensions of the pockets extend in the direction from the upper edge of the trapezoidal component toward the lower edge thereof. The two pockets are approximately parallel to the axis of symmetry 44 of the trapezoidal component and are symmetrically disposed at opposite respective sides of the axis of symmetry. Each pocket has four walls that extend generally perpendicular to the component 10 and a flap 46 that is an extension of one of the longer walls and is releasably attachable to the two shorter walls and the opposite longer wall using a zip fastener 48 that allows that pocket to be opened. The height of each pocket is sufficient to accommodate up to three spacers 50, each of which is approximately 1.3 cm in thickness. The spacers are made of a stiff rubber material.

In use of the training aid to increase the weight level that is lifted in the bench press exercise, the lifter fits at least one, and generally all three spacers, in each pocket 40, releases the two clips 28 and fits the aid over his head with the two upper straps 18 over his shoulders, the ring 24 at his back and the trapezoidal fabric component over his chest. He can then pass the lower straps 32 under his arms and engage the clips 28. The lifter adjusts the slide buckles 20 and 34 so that the aid fits snugly with the component 10 positioned with the axis of symmetry 44 running down his sternum and the two pockets 40 substantially at the level of his shoulders. The pockets 40 are then positioned so that they traverse the location of the groove into which the lifter lowers the barbell during the bench press exercise. The lifter lies supine on the bench and grasps the barbell with the increased weight in its rest. The lifter then lowers the barbell in the usual fashion until the bar 52 just touches the training aid. The sensation of contact between the bar and the training aid is transmitted to the lifter's chest through the fabric of the training aid and the flexible spacers, and the lifter is able to tell readily whether the barbell is in the groove. Because the combined thickness of the three spacers in each pocket is about 3.9 cm, the bar is still at least about 4 cm from the lifter's chest. The lifter is aware from experience that the effort that he can exert on the barbell at a height of 4 cm above his chest is substantially higher than if the bar were actually touching his chest, and therefore he is not intimidated by the increased weight of the barbell, and furthermore, he is protected from injury due to excessive stress on the arm and shoulder. The lifter trains at the increased weight and with all three spacers in each pocket until he feels comfortable and confident and can execute the desired number of repetitions at the increased weight, and then he removes one or more spacers from each pocket. The lifter then trains at the lower number of spacers until he can comfortably and confidently execute the desired number of repetitions. This sequence of training with a given number of spacers in each pocket until a level of comfort and confidence is reached and removing at least one spacer from each pocket and resuming training at the reduced number of spacers is continued until all the spacers have been removed, at which point the lifter no longer requires the training aid and can train at the increased weight without need for the aid. In this manner, the lifter develops confidence at the increased weight progressively and with a reduced risk of injury to the arm and shoulder.

Figure 4:
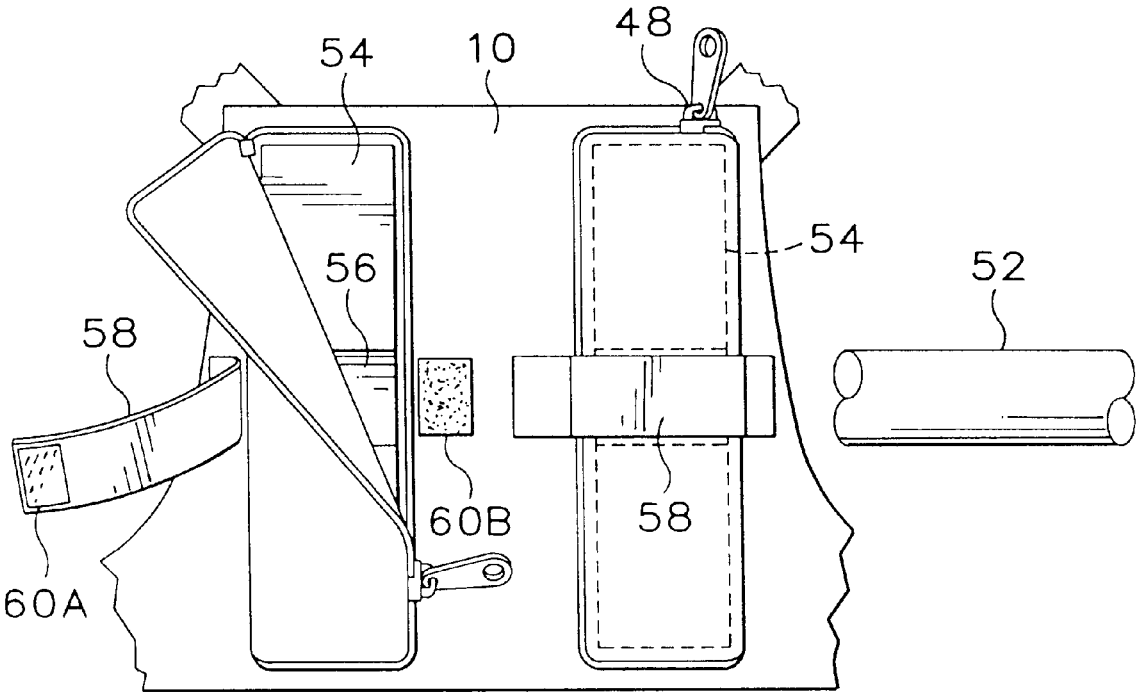
FIG. 4 is a view similar to FIG. 1 of a second training aid in accordance with the present invention.
Figure 5:
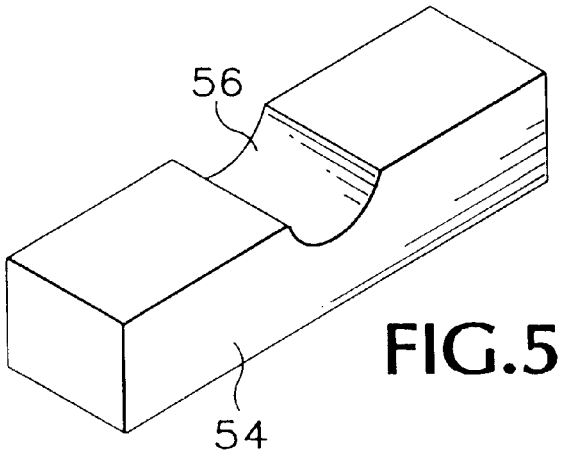
FIG. 5 is a perspective view of a component of the training aid shown in FIG. 4.

In the second training aid, a set of, for example, three different sized spacer's is provided for each pocket, and only one spacer is used at a time in each pocket. A first spacer may have a thickness of about one inch, a second may have a thickness of about 1.5 inches and a third a thickness of about 2 inches. Referring to FIGS. 4 and 5, each 54 has a recess 56 having a depth of about one half inch in its upper surface. The lifter places two spacers 54 of the same thickness in the pockets respectively, with the recess 56 outward, and adjusts the slide buckles 20 and 34 so that the recesses are positioned at the location of the groove. When the lifter performs the bench press exercise, he is able to adjust the position of the barbell on the downward part of the movement so that the barbell partially seats in the recesses in the plates and thereby obtain confirmation that the barbell is in the groove. This reinforces the lifter's training, and assists him in learning the proper path of downward movement to attain a bottom position in which the barbell is in the groove.

In use of the second training aid, the lifter initially trains at an increased weight level with the two thickest spacers in the pockets. When the lifter is comfortable and confident that he can execute the desired number of repetitions at the increased weight level, he removes the thickest spacers and replaces them with the intermediate spacers. The lifter then trains with the intermediate spacers until he can comfortably and confidently execute the desired number of repetitions, and he then removes the intermediate spacers and replaces them with the thinnest spacers. When the lifter can comfortably and confidently execute the desired number of repetitions with the thinnest spacers, he can train at the increased weight level without need for the training aid.

With the second training aid, it is not necessary to place more than one spacer in each pocket, and this is advantageous because with fewer spacers, there is a reduced danger of misplacing a spacer. Moreover, a single spacer is more stable in the pocket than two or more spacers, which can slide against each other.

A spacer with a groove, as described with reference to FIGS. 4 and 5, provides two different effective thicknesses, depending on its orientation.

Preferably, a webbing strap 58 is attached to the trapezoidal fabric component 10 by stitching adjacent one side of each pocket. One part 60A of a strip of hook-and-loop fastener material, such as the material sold under the trademark VELCRO, is sewn to the free end of the strap and the other part 60B is sewn to the component 10 on the other side of the pocket. When a spacer 54 has been placed in the pocket and the zip fastener 48 closed, the lifter passes the strap 58 over the pocket and secures its free end to the component 10. The strap is positioned on the component 10 so that it fits at least partially into the recess 56 in the spacer and thereby stabilizes the spacer against movement relative to the component 10. The strap 58 assists the lifter in visually identifying the target for the lowering phase of the movement, since the strap is positioned in the groove.

A training aid in accordance with the invention may be used not only in carrying out the bench press exercise, but also in carrying out the incline press and decline press exercises. The incline press and decline press are similar to the bench press except that the bench is not horizontal, and consequently the relative stresses on the different muscles are different. Thus, in the incline press, the shoulders are higher than the hips and this shifts the stress primarily to the deltoids and triceps. In the case of the decline press, the hips are higher than the shoulders and this shifts the stress primarily to the lower and outer section of the pectoralis major and to the anterior deltoids.

It will be appreciated that the invention is not restricted to the particular embodiments that have been described, and that variations may be made therein without departing from the scope of the invention as defined in the appended claims and equivalents thereof. For example, the training aid is not restricted to the plates being attached to the harness by fitting in pockets, and other means for attaching the spacers to the harness may be used instead. In particular, the second training aid may be modified by attaching one part of a strip of hook-and-loop fastener material to the fabric component 10 by stitching and attaching the other part to a spacer using adhesive material, and the spacer can then be attached to the harness by engaging the two parts of the hook-and-loop fastener material. Further, the spacer may be permanently attached to the harness, in which case the lifter may have several harnesses with different thickness plates.

I claim:

1. A method of training for a bench press exercise, in which one lifts a bar from a lower position to a higher position while lying on one's back, said method comprising:

(a) providing a training aid which comprises a harness including an attachment means by which at least one spacer is releasably attached to the harness, (b) attaching the training aid to one's body so that the spacer is at a position in which it limits the extent to which the bar can be lowered from its higher position toward its lower position before contacting the training aid, (c) lying on a bench with one's buttocks, shoulders and head in contact with the bench, (d) lowering the bar from its higher position to a position in which the bar touches the training aid, (e) lifting the bar from the position in which the bar touches the spacer to said higher position, (f) detaching the spacer recited in step (a) from the harness and replacing it with a second spacer of lesser thickness than the spacer recited in step (a), (g) lowering the bar from its higher position to a position in which the bar touches the second spacer, and (h) lifting the bar from the position in which the bar touches the second spacer to said higher position.

2. A method according to claim 1, wherein the attachment means includes a pocket in which at least two spacers can be removably inserted, one on top of the other, for attaching the spacers to the harness, and the method further comprises:

(f) removing a first spacer from the pocket and leaving a second spacer in the pocket, (g) lowering the bar from its higher position to a position in which the bar touches the pocket, and (h) lifting the bar from the position in which the bar touches the pocket to said higher position.

3. A method according to claim 1, wherein the spacer is formed with a lateral groove and step (d) comprises lowering the bar so that the bar is received in the groove.

4. A method of training for a bench press exercise in which one lifts a bar from a lower position to a higher position while lying on one's back, said method comprising:

(a) providing a training aid comprising a harness and a first spacer attached to the harness, (b) attaching the training aid to one's body so that the spacer is at a position in which it limits the extent to which the bar can be lowered from its higher position toward its lower position before contacting the training aid, (c) lying on a bench with one's buttocks, shoulders and head in contact with the bench, (d) lowering the bar from its higher position to a position in which the bar touches the first spacer, (e) lifting the bar from the position in which the bar touches the first spacer to said higher position, (f) replacing the first spacer with a second spacer of lesser thickness than the first spacer, (g) lowering the bar from its higher position to a position in which the bar touches the second spacer, and (h) lifting the bar from the position in which the bar touches the second spacer to said higher position.

5. A method of training for a bench press exercise, in which one lifts a bar from a lower position to a higher position while lying on one's back, said method comprising:

(a) providing a training aid comprising a harness which has left and right sides disposed at opposite respective sides of a central plane and includes first and second pockets which are substantially symmetrically positioned with respect to said central plane, on the left and right sides respectively of the harness, and in each of which at least two spacers can be removably inserted, one on top of the other, for attaching the spacers to the harness, (b) attaching the training aid to one's body so that the spacers are at positions in which they limit the extent to which the bar can be lowered from its higher position toward its lower position before contacting the training aid;

(c) lying on a bench with one's buttocks, shoulders and head in contact with the bench, (d) lowering the bar from its higher position to a position in which the bar touches the pockets, (e) lifting the bar from the position in which the bar touches the pockets to said higher position, (f) removing a first spacer from each pocket and leaving a second spacer in each pocket, (g) lowering the bar from its higher position to a position in which the bar touches the pockets, and (h) lifting the bar from the position in which the bar touches the pockets to said higher position.

* * * * *